US008362855B2

(12) United States Patent
Lee

(10) Patent No.: US 8,362,855 B2
(45) Date of Patent: Jan. 29, 2013

(54) TUNING BOLT GROUND CONNECTION STRUCTURE AND RF CAVITY FILTER INCLUDING SAME

(75) Inventor: Seung-Cheol Lee, Incheon (KR)

(73) Assignee: Ace Technologies Corporation, Incheon (KR)

( * ) Notice: Subject to any disclaimer, the term of this patent is extended or adjusted under 35 U.S.C. 154(b) by 0 days.

(21) Appl. No.: 13/234,923

(22) Filed: Sep. 16, 2011

(65) Prior Publication Data

US 2012/0049982 A1 Mar. 1, 2012

Related U.S. Application Data

(63) Continuation of application No. PCT/KR2010/001672, filed on Mar. 18, 2010.

(30) Foreign Application Priority Data

Mar. 18, 2009 (KR) ..... 10-2009-0023256

(51) Int. Cl.
*H01P 1/208* (2006.01)
*H01P 7/06* (2006.01)

(52) U.S. Cl. ..... 333/203; 333/232; 333/235

(58) Field of Classification Search ..... 333/207, 333/209, 223, 226, 231, 232, 235, 203
See application file for complete search history.

(56) References Cited

U.S. PATENT DOCUMENTS

| | | | | |
|---|---|---|---|---|
| 4,035,749 | A * | 7/1977 | Slocum et al. | 333/232 |
| 4,041,421 | A * | 8/1977 | Owlett | 333/209 |
| 6,111,484 | A * | 8/2000 | Henningsson et al. | 333/231 |
| 6,535,086 | B1 * | 3/2003 | Liang et al. | 333/219.1 |
| 6,734,766 | B2 * | 5/2004 | Lye et al. | 333/203 |
| 7,227,434 | B2 * | 6/2007 | Haraldsson et al. | 333/232 |
| 8,072,298 | B2 * | 12/2011 | Kim et al. | 333/202 |
| 2003/0193379 | A1 | 10/2003 | Lye et al. | |

FOREIGN PATENT DOCUMENTS

| | | | |
|---|---|---|---|
| JP | 2003-307208 | A | 10/2003 |
| KR | 2002-52351 | | 3/2004 |
| KR | 10-0761801 | * | 10/2007 |

* cited by examiner

*Primary Examiner* — Seungsook Ham
(74) *Attorney, Agent, or Firm* — Edwards Wildman Palmer LLP

(57) ABSTRACT

An RF cavity filter is disclosed. The disclosed filter includes: a housing having at least one cavity defined; a cover coupled to an upper portion of the housing; at least one resonator contained within the at least one cavity; at least one hole formed in the cover; at least one grounding bolt configured to be inserted into the hole, having a screw thread formed on a part of an outer perimeter, and having a center hole in a center portion; and at least one tuning bolt inserted into the housing through the center hole along a screw thread formed on an inner perimeter of the center hole, where the grounding bolt has a flange part formed on a lower portion that is in contact with the tuning bolt and a lower portion of the cover.

7 Claims, 9 Drawing Sheets

TUNING BOLT GROUND CONNECTION STRUCTURE AND RF CAVITY FILTER INCLUDING SAME

CROSS-REFERENCE TO RELATED APPLICATION

This application is a continuation of PCT/KR2010/001672 filed Mar. 18, 2010, which claims the benefit of Korean Application No. 10-2009-0023256 filed Mar. 18, 2009, the entire contents of which applications are incorporated herein by reference.

TECHNICAL FIELD

The present invention relates to an RF cavity filter, more particularly to a tuning bolt ground connection structure included in an RF cavity filter.

BACKGROUND ART

A filter is an apparatus for passing only signals of specific frequency band out of all input frequency signals, and is implemented in a variety of forms. The band passing frequency of an RF filter is determined by the inductance components and capacitance components of the filter, and the work of adjusting filter characteristics such as band passing frequency and bandwidth of the filter is called tuning.

FIG. 1 is a drawing illustrating the structure of a general RF cavity filter of the related art.

Referring to FIG. 1, a general RF cavity filter of the related art comprises a housing 100, an input connector 102, an output connector 104, a cover 106, multiple cavities 108, and a resonator 110.

An RF filter is an apparatus for passing only signals of specific frequency band out of all input frequency signals, and is implemented in a variety of forms.

The inside of a filter has multiple walls, which define cavities 108 in which individual resonators are placed. The cover is equipped with coupling holes and tuning bolts 112 for coupling the housing 100 and the cover 106.

The tuning bolts 112 are coupled to the cover 106, penetrating into the inside of the housing. The tuning bolts 112 are placed on the cover 106 in correspondence with the resonators or designated positions within the cavities.

RF signals are input by the input connector 102 and output to the output connector 104, and proceed through a coupling window formed in each of the cavities. Resonance phenomenon of RF signals occurs by means of the cavities 108 and resonators 110, and RF signals are filtered by means of the resonance phenomenon.

In a filter of the related art such as that illustrated in FIG. 1, tuning for frequency and bandwidth is achieved by tuning bolts.

FIG. 2 is a drawing illustrating a cross-section of a cavity in an RF cavity filter of the related art.

Referring to FIG. 2, the tuning bolt 112 penetrates the cover 106 and is positioned above the resonator. The cover 106 has holes for tuning bolts to go through, and the holes have screw threads formed therein.

The tuning bolts 112 can be turned along the screw threads formed in the holes, so that the distance between it and the resonator may be adjusted, and tuning is achieved by changing the distance between the resonator 110 and the tuning bolt 112. The tuning bolt 112 may be turned manually, or by a separate tuning machine for turning the tuning bolt.

The tuning bolt should be connected electrically with a ground, and is conventionally connected through the cover and screw thread of a grounded filter. Here, there exist micro-gaps between screw threads, and oxidized material can form in such gaps. Oxidized material that forms in the gaps is a major cause of a spark phenomenon and Passive Inter-Modulation Distortion (PIMD) when an RF cavity filter is used in high power, and such spark phenomenon and PIMD are factors that impede stable grounding of tuning bolts.

To prevent such phenomena, U.S. Pat. No. 4,775,847 proposed a structure that connects a separate grounding member between the underside of the filter cover and the tuning bolt, so that the electric current passes through the grounding member and flows to the filter cover.

FIG. 3 is a drawing illustrating an example of a tuning bolt grounding structure using a grounding member to prevent the spark phenomenon and PIMD at high power.

Referring to FIG. 3, in the tuning bolt grounding structure using a grounding part proposed by U.S. Pat. No. 4,775,847, a grounding member 302 is additionally included, and the grounding member 302 provides another path for the electric current to flow from the tuning bolt through the grounding part to the filter cover, besides the path for the electric current to flow from the tuning bolt 300 through the screw threads to the filter cover. The grounding member is coupled to the filter cover by means of rivets.

When a foreign material occurs in the gaps between screw-threads on the inside of a hole, the electrical current will flow in the path passing through the grounding member, due to a difference in impedance, and as a result, a spark phenomenon by the foreign material can be prevented.

However, such tuning bolt grounding structure according to the related art has the problem of being vulnerable to PIMD. PIMD refers to the phenomenon whereby two or more signal frequencies cause interference in passive components, thus causing unwanted parasitic signals.

Causes of PIMD in RF components can be largely divided into two categories: contact nonlinearity and material nonlinearity. Among the factors causing contact nonlinearity are: junction capacitance due to a thin layer of oxidation between conductors; tunnel effect due to semiconductor action between conductors in metal contact; micro-discharge due to empty spaces and minute cracks between metals; nonlinearity related to dust and metal particles on the metal surfaces; and constriction resistance occurring in metallic bonds. Among the factors causing material linearity are: hysteresis effect of nickel, iron, cobalt, etc.; internal Schottkey effect; and thermal heating due to limited conductivity in a conductor.

The conventional tuning bolt grounding structure illustrated in FIG. 3 is one whereby contact nonlinearity increases as contact area between metals increases and especially as the grounding member and the filter cover are coupled by means of rivets, and is one that is inevitably vulnerable to PIMD.

Also, since the grounding member and tuning bolt are in linear contact, the contact area is small and cannot have sufficient grounding effect, and has the problem of being vulnerable to the external environmental factors such as vibration.

In recent times, elimination of PIMD is one of the main challenges in improving the performance of mobile communication systems, and requires a tuning bolt grounding structure that can suppress the occurrence of PIMD.

The above information disclosed in this Background section is only for enhancement of understanding of the background of the invention and therefore it may contain information that does not form the prior art that is already known in this country to a person of ordinary skill in the art.

SUMMARY OF THE DISCLOSURE

To resolve the problem of the related art addressed above, an aspect of the invention provides a tuning bolt ground connection structure and an RF cavity filter having the same. Another purpose of the invention is to provide a tuning bolt ground connection structure that can obtain sufficient grounding area and an RF cavity filter having the same.

Yet another purpose of the invention is to provide a tuning bolt ground connection structure that is less influenced by external environmental factors such as vibrations, and an RF cavity filter having the same.

Other purposes of the present invention can be derived through the embodiments below by those skilled in the related art.

To achieve the objective above, an aspect of the invention provides an RF cavity filter that includes: a housing having at least one cavity defined; a cover coupled to an upper portion of the housing; at least one resonator contained within the at least one cavity; at least one hole formed in the cover; at least one grounding bolt configured to be inserted into the hole, having a screw thread formed on a part of an outer perimeter, and having a center hole in a center portion; and at least one tuning bolt inserted into the housing through the center hole along a screw thread formed on an inner perimeter of the center hole, where the grounding bolt has a flange part formed on a lower portion that is in contact with the tuning bolt and a lower portion of the cover.

The grounding bolt should preferably be composed of an elastic material. The flange part should preferably be shaped as a round disc and have an upward slope of a designated incline.

The grounding bolt is secured by a securing element, which is configured to secure the grounding bolt by applying a force vertically upward on the grounding bolt.

The force applied vertically upward causes the grounding bolt to move upward vertically, such that a contact between the tuning bolt and the grounding bolt is enforced and the contact between the lower portion of the cover and the flange part is enforced as the center hole is made narrower by the vertically upward movement.

The securing element may include a nut.

Another aspect of the invention provides a grounding bolt for grounding a tuning bolt of an RF cavity filter, which includes: a body having a cylindrical shape; a screw thread part formed on part of an outer perimeter of the body; a center hole formed in a center of the body; an inner screw thread part formed on an inner perimeter of the center hole; and a flange part shaped as a round disc that is formed on a lower portion of the body, where a tuning bolt used in tuning of the RF cavity filter is inserted into the center hole, and the flange part is in contact with the tuning bolt and a cover of the RF cavity filter.

The present invention is able to minimize occurrences of PIMD in a tuning bolt ground connection structure, and to obtain sufficient grounding area. Also, it has the advantage of being less influenced by external environmental factors such as vibrations.

DETAILED DESCRIPTION OF THE DISCLOSURE

The tuning bolt ground connection structure and RF cavity filter having the same according to certain embodiments of the invention will be described below in more detail with reference to the accompanying drawings.

Figure 4:
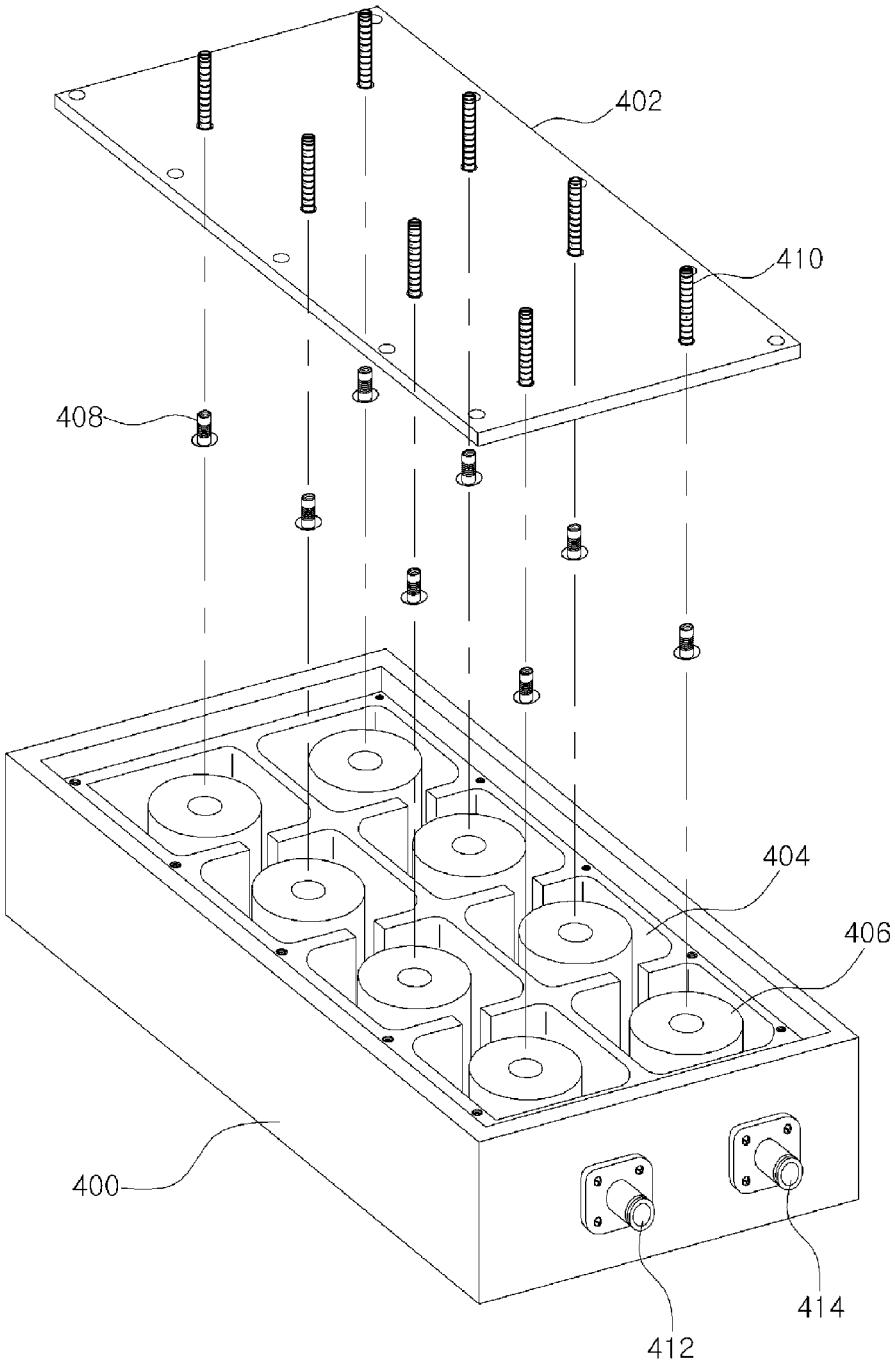
FIG. 4 is a drawing illustrating an exploded perspective view of an RF cavity filter using a tuning bolt ground connection structure according to an embodiment of the present invention.
Figure 5:
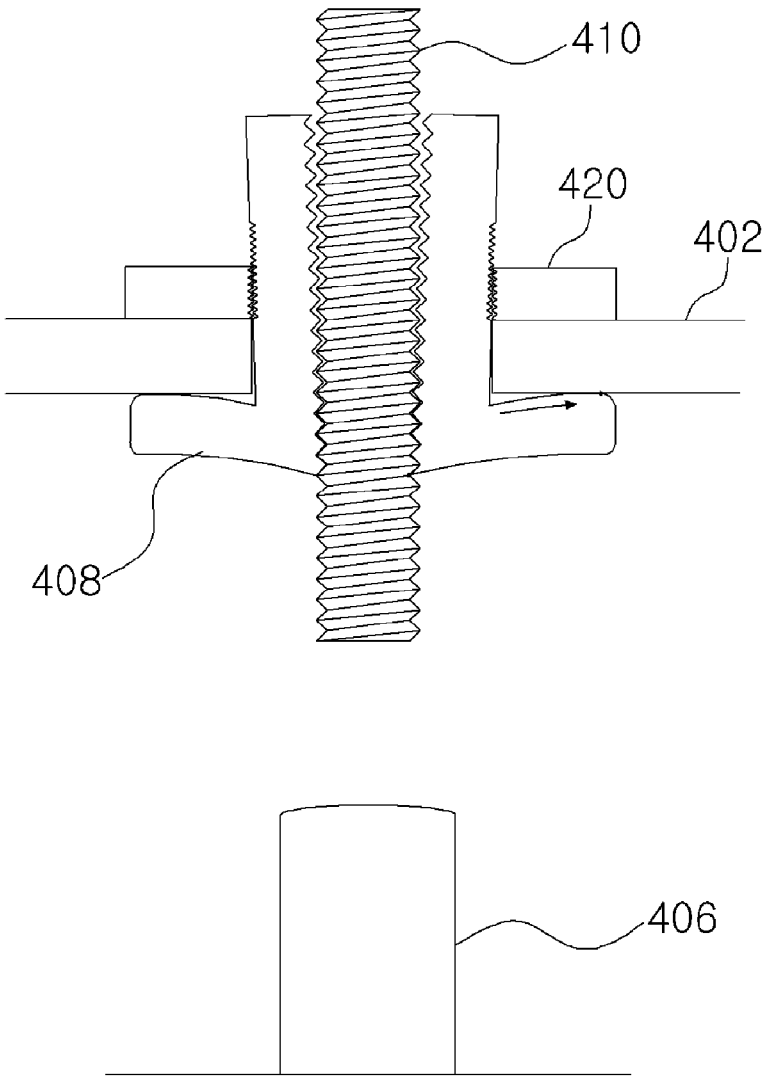
FIG. 5 is a drawing illustrating a cross-sectional view of a cavity in an RF cavity filter using a tuning bolt ground connection structure according to an embodiment of the present invention.

FIG. 4 is a drawing illustrating an exploded perspective view of an RF cavity filter using a tuning bolt ground connection structure according to an embodiment of the present invention, and FIG. 5 is a drawing illustrating a cross-sectional view of a cavity in an RF cavity filter using a tuning bolt ground connection structure according to an embodiment of the present invention.

Referring to FIGS. 4 and 5, an RF cavity filter using a tuning bolt ground connection structure according to an embodiment of the present invention may include a housing 400, a cover 402, multiple cavities 404, multiple resonators 406 each of which is to be included in each of the cavities, grounding bolts 408, tuning bolts 410, an input connector 412, an output connector 414, and nuts 420.

The housing 400 serves to protect component parts such as the resonators 406 inside the filter and shield electromagnetic waves. The housing 400 may be of one in which the base is formed from an aluminum material and subsequently plated. Usually, silver-plating is used in RF apparatuses such as filters and wave guide tubes in order to minimize loss, as silver-plating has excellent conductivity. In recent years, other types of plating methods besides silver-plating are also used to improve characteristics such as corrosion resistance, and a housing treated with such plating methods may also be used. The housing has multiple walls inside, with the housing and walls defining multiple cavities 404.

The cover 402 is coupled to an upper portion of the housing, and may be coupled onto the upper portion of the housing by way of bolts, for example. The cover may also be of an aluminum base, preferably with its lower portion treated with electroplating such as silver-plating.

Each of the multiple cavities 404 has a resonator 406, the number of resonators and cavities being related to insertion loss and skirt characteristics of the filter. Increasing the number of resonators and cavities entails the trade-off of providing better skirt characteristics in the filter but worse insertion loss, and thus the number of resonators and cavities is determined by the required insertion loss and skirt characteristics.

FIGS. 4 and 5 illustrate resonators of cylindrical shape, but resonators of various shapes, such as disc-shaped resonators, may be used, and they may be composed of metal or dielectric material depending on the mode of the filter (TE mode or TM mode).

The RF cavity filter according to an embodiment of the present invention provides grounding bolts 408 which are partially inserted into the housing and partially protrude out of the housing. The grounding bolts 408 are inserted from a lower portion of the cover 402, protruding out of the upper portion of the cover 402. Therefore, the grounding bolts 408 should preferably be coupled to the cover 402 before the cover 402 and the housing 400 are fastened together.

The grounding bolts 408 are inserted from the lower portion of the cover to the upper portion through holes 450 in the cover.

Figure 6:
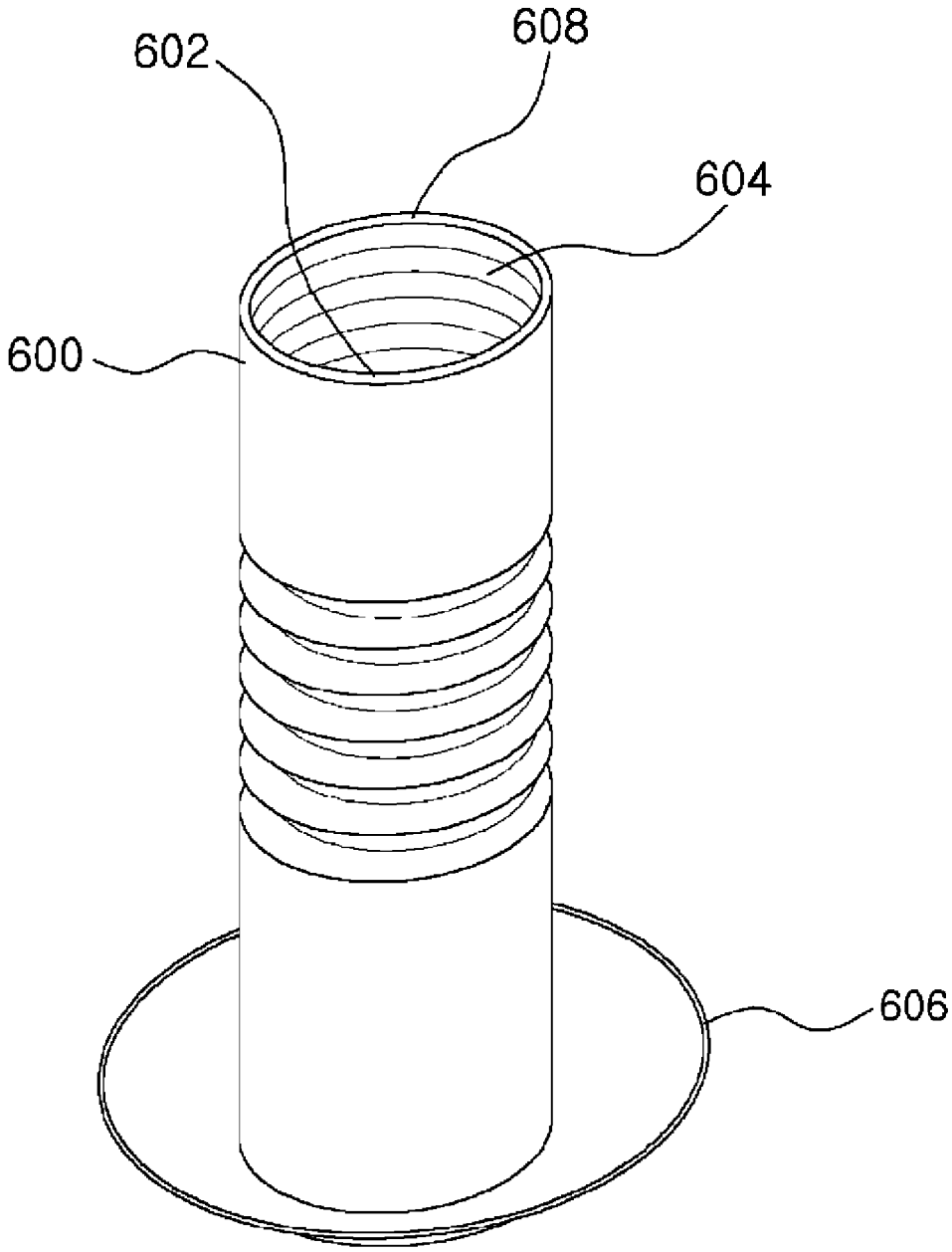
FIG. 6 is a drawing illustrating a perspective view of a grounding bolt provided in an RF cavity filter according to an embodiment of the present invention.

FIG. 6 is a drawing illustrating a perspective view of a grounding bolt provided in an RF cavity filter according to an embodiment of the present invention.

Referring to FIG. 6, a grounding bolt provided in the RF cavity filter according to an embodiment of the present invention may include an outer perimeter screw thread 600, a center hole 602, an inner perimeter screw thread 604, a flange part 606, and a cylindrically shaped body 608.

The outer perimeter screw thread 600 is formed on part of the outer perimeter of the grounding bolt. The outer perimeter screw thread 600 is for securing the grounding bolt with a nut 420.

The center hole 602 is formed in a center portion of the grounding bolt, and the center hole 602 is for inserting the tuning bolt 410. The inner perimeter of the center hole 602 has a screw thread 604, and the tuning bolt 410 is inserted into the interior of the filter through rotation along the inner perimeter screw thread 604 formed inside the center hole 602.

The flange part 606 is in the shape of a round disc at a lower portion of the grounding bolt. As illustrated in FIG. 6, the flange part 606 has an upwardly sloping structure, and because of this sloping structure, the edge of the flange part is placed in contact with the lower portion of the cover 400.

The grounding bolt may be implemented with elastic metallic material, and as an example, may be implemented with the same material as the tuning bolt.

Figure 7:
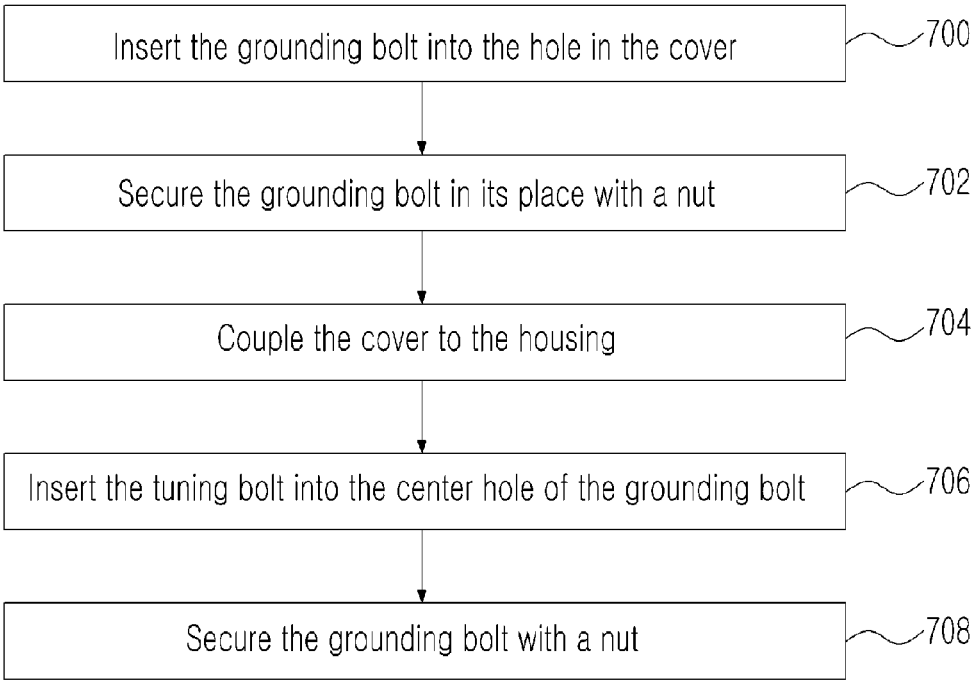
FIG. 7 is a flow chart illustrating the process of fastening and tuning a grounding bolt of an RF cavity filter according to an embodiment of the present invention.

FIG. 7 is a flow chart illustrating the process of fastening a grounding bolt and tuning of an RF cavity filter according to an embodiment of the present invention.

Referring to FIG. 7, the grounding bolt 408 is first inserted through the hole 450 in the cover 402, in operation 700. As described above, the grounding bolt 408 is inserted upward from the lower to the upper portion of the cover 402.

Once the grounding bolt 408 is inserted upward from the lower portion of the cover 402, a nut is coupled to the part of the grounding bolt protruding upward in order to secure the grounding bolt 408 in its place (coupled along the outer perimeter screw thread of the grounding bolt), and here the nut is not tightly fastened such that the grounding bolt is completely affixed to the filter cover, but rather, relatively loosely fastened, just so that the grounding bolt 408 may not fall downward, in operation 702.

Once the grounding bolt 408 is secured in its place, the cover 402 is coupled to the housing, in operation 704. The cover 402 may be coupled to the housing by using a bolt, etc.

Once the cover 402 is coupled to the housing 400, the tuning bolt 410 is inserted through the center hole of the grounding bolt, in operation 704. A user may perform the tuning of the filter by adjusting the distance between the tuning bolt and the resonator by rotating the tuning bolt, in operation 706.

Figure 8:
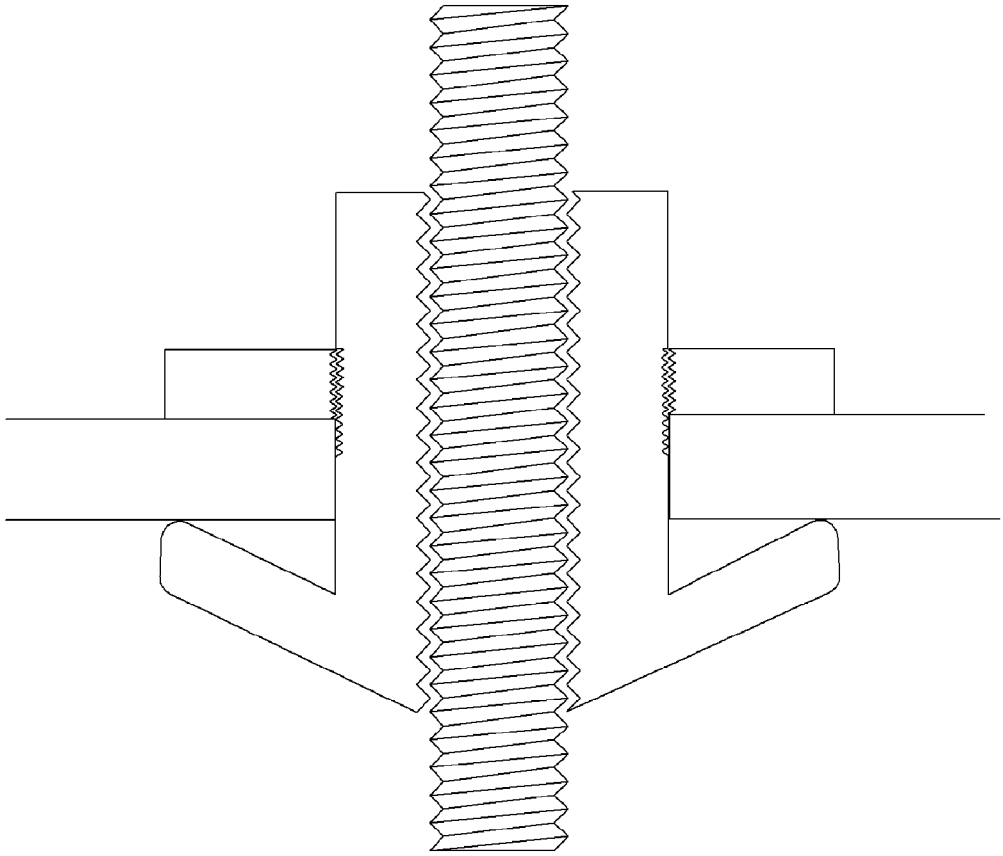
FIG. 8 is a drawing illustrating a tuning bolt inserted into a grounding bolt according to an embodiment of the present invention.

FIG. 8 is a drawing illustrating a tuning bolt inserted into a grounding bolt according to an embodiment of the present invention. As illustrated in FIG. 8, the tuning bolt is rotated and inserted through the center hole as the screw thread on the outer perimeter of the tuning bolt and the screw thread on the inner perimeter of the center hole engage each other.

Once the distance between the resonator and the tuning bolt is adjusted, the nut is tightly fastened to affix the grounding bolt to the cover, in operation 706.

Figure 9:
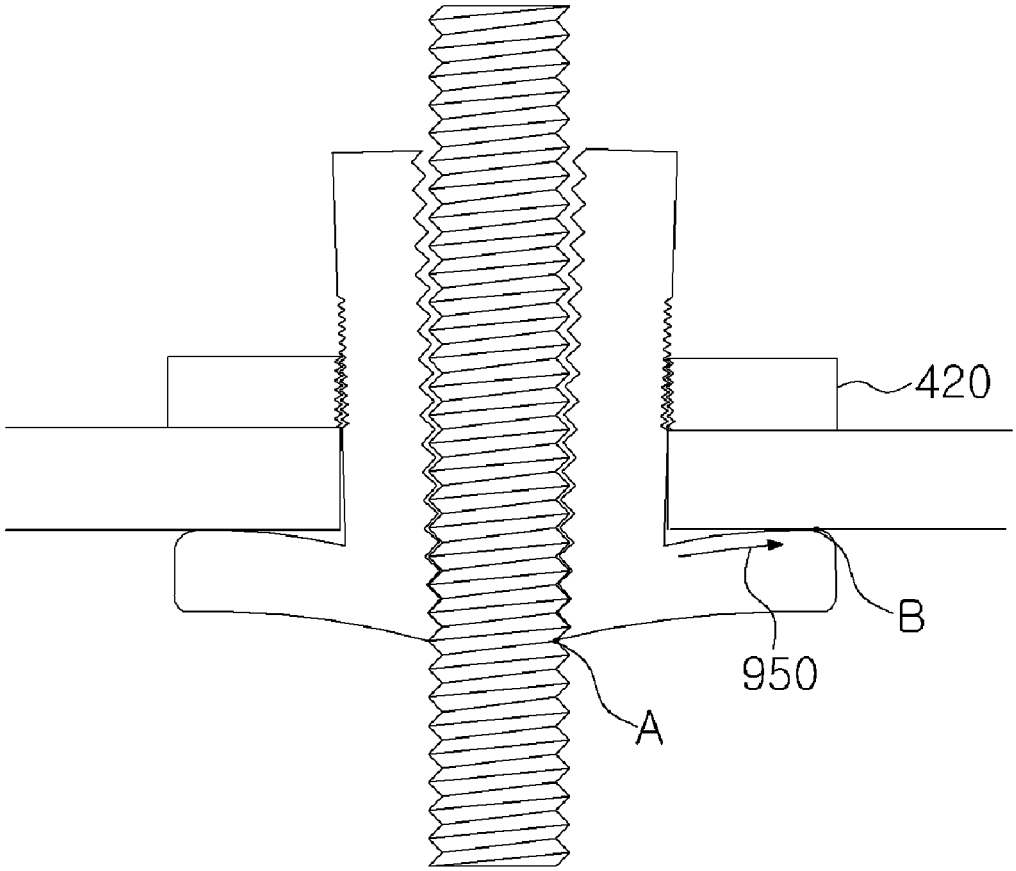
FIG. 9 is a drawing illustrating a grounding bolt secured by a nut.

FIG. 9 is a drawing illustrating a grounding bolt tightly affixed to the cover with a tightly fastened nut according to an embodiment of the present invention.

Referring to FIG. 9, the grounding bolt is given a vertically upward force by the securing by the nut 900, and the grounding bolt makes a slight upward movement. Due to such vertically upward movement, the center hole of the grounding bolt, which is composed of elastic material, is made narrower, while the sloping structure of the flange is bent.

After tuning is completed, as the center hole gets narrower with the application of the vertically upward force to the grounding bolt, the coupling between the tuning bolt and the grounding bolt becomes more firm at point A. In other words, the surface contact between the tuning bolt and the flange part at point A is enforced, simultaneously achieving securing of the tuning bolt.

Also, as the sloping structure of the flange part becomes less steep with the application of the vertical upward force, at the same time the contact between the lower portion of the cover and the flange part at point B is made more secure, and the contact area between the flange part and the cover increases.

Referring to FIG. 9, with the contact area between the flange part and the tuning bolt at point A and the contact area between the flange part and the lower portion of the cover at point B, a new path for electric current 950 is formed that passes through the flange part.

In the path for electric current 950 that passes through the flange part, no gaps exist where oxidized material can form, and therefore, more secure grounding can be provided than when no separate grounding member is equipped.

Figure 1:
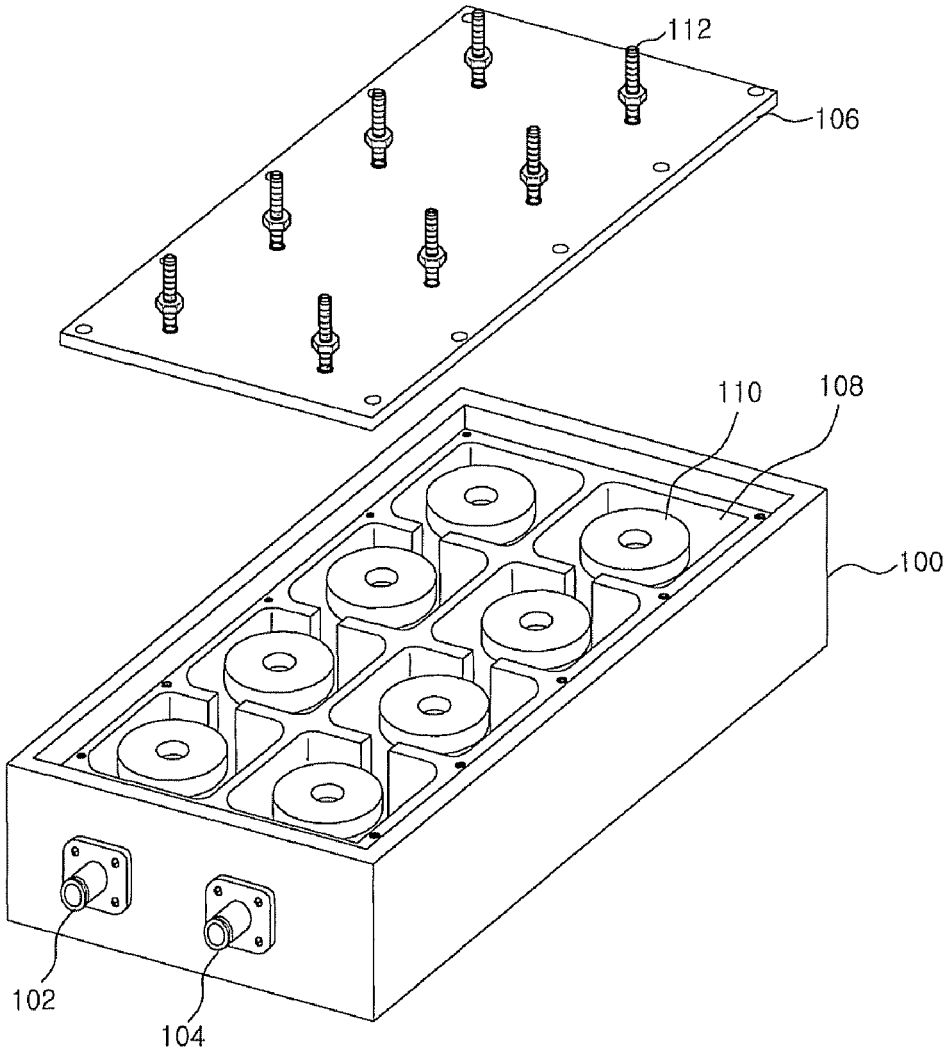
FIG. 1 PRIOR ART
FIG. 1 is a drawing illustrating the structure of a general RF cavity filter of the related art.
Figure 2:
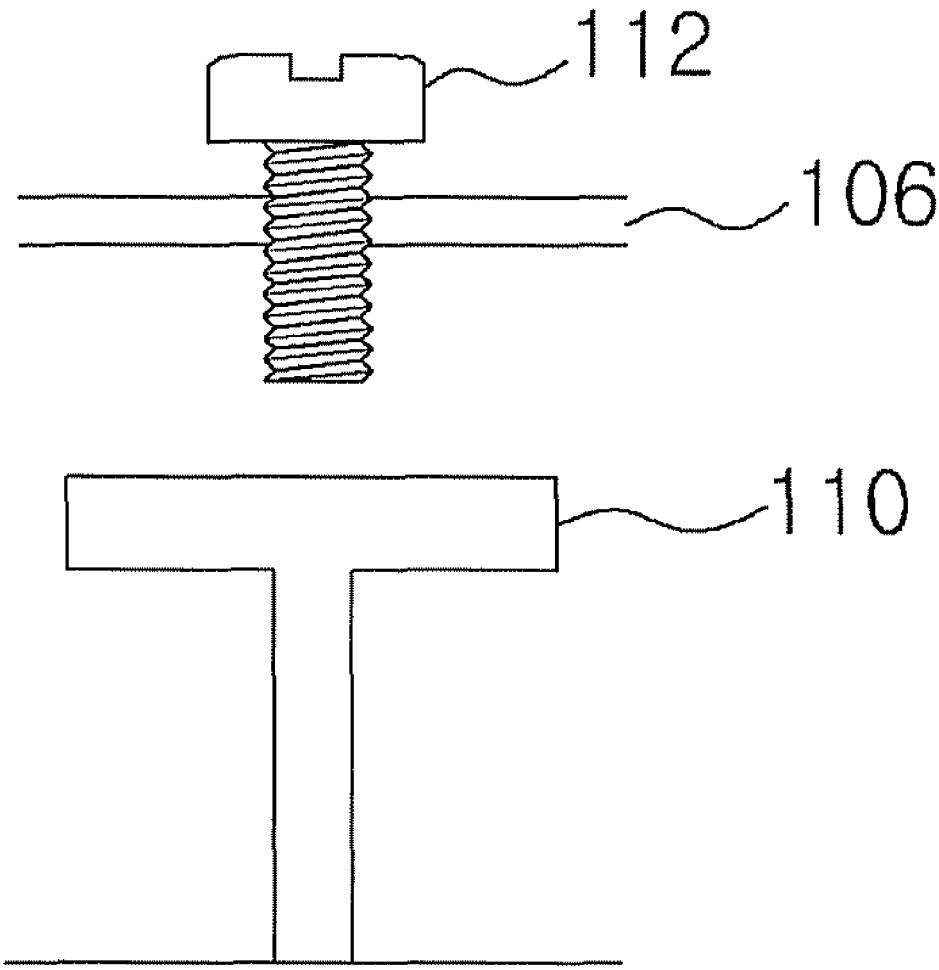
FIG. 2 PRIOR ART
FIG. 2 is a drawing illustrating a cross-section of a cavity in an RF cavity filter of the related art.
Figure 3:
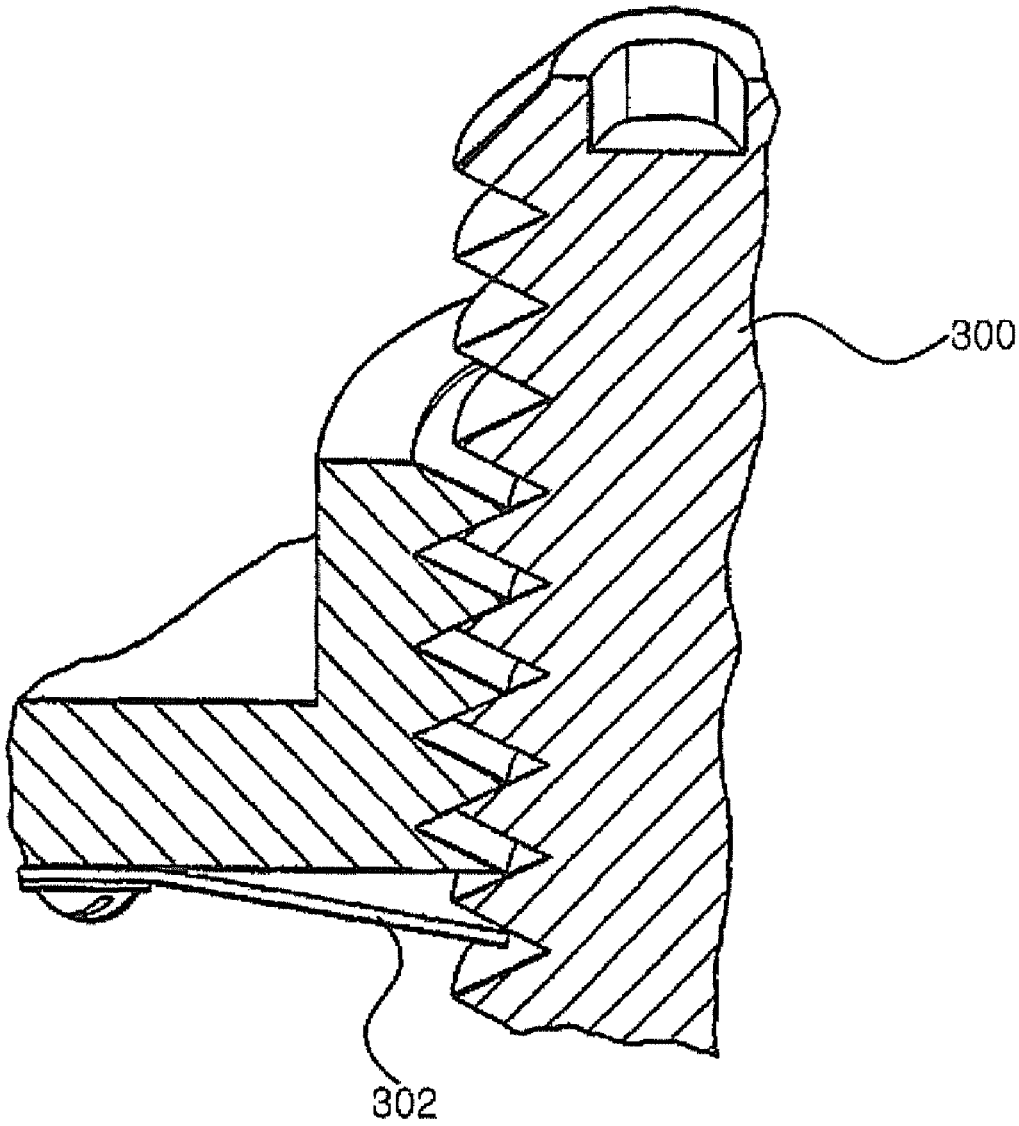
FIG. 3 PRIOR ART
FIG. 3 is a drawing illustrating an example of a tuning bolt grounding structure using a grounding member to prevent the spark phenomenon and PIMD at high power.

Also, as the flange part and the tuning bolt come in surface contact at point A, more secure contact can be achieved than when the grounding member in FIG. 3 is used, and there is less influence from external factors such as vibrations. Also, through surface contact, it becomes possible to provide a more sufficient grounding effect than when using the grounding member in FIG. 3.

Furthermore, as the elastic flange part is in contact with the lower portion of the cover, there is the advantage of suppressing the occurrence of PIMD more than when the grounding member is coupled by rivets as in FIG. 3.

While the spirit of the invention has been described in detail with reference to particular preferred embodiments, it is to be appreciated that those skilled in the art can change or modify the embodiments without departing from the scope and spirit of the invention as set forth in the claims below.

The invention claimed is:

1. An RF cavity filter comprising:

a housing having at least one cavity defined therein;

a cover coupled to an upper portion of the housing;

at least one resonator contained within the at least one cavity;

at least one hole formed in the cover;

at least one grounding bolt made of an elastic material and configured to be inserted into the hole, the grounding bolt having a screw thread formed on a part of an outer perimeter thereof and having a center hole in a center portion thereof; and at least one tuning bolt inserted into the housing through the center hole along a screw thread formed on an inner perimeter of the center hole, wherein the grounding bolt further comprises:

a body having a cylindrical shape;

an inner screw thread part formed on an inner perimeter of the center hole; and a flange part formed on a lower portion of the body, the flange part shaped as a round disc, being in contact with the tuning bolt and a cover of the RF cavity filter and having an upward slope of a designated incline for being in contact with the tuning bolt and the underside of the cover.

2. The RF cavity filter according to claim 1, wherein the grounding bolt is secured by a securing element, the securing element configured to secure the grounding bolt by applying a force vertically upward on the grounding bolt.

3. The RF cavity filter according to claim 2, wherein the force applied vertically upward causes the grounding bolt to move upward vertically, such that a contact between the tuning bolt and the grounding bolt is enforced and the contact between the lower portion of the cover and the flange part is enforced as the center hole is made narrower by the vertically upward movement.

4. The RF cavity filter according to claim 2, wherein the securing element includes a nut, and the nut is coupled by way of the screw thread formed on the part of the outer perimeter.

5. A grounding bolt for grounding a tuning bolt of an RF cavity filter, the grounding bolt made of an elastic material and comprising:

a body having a cylindrical shape;

a screw thread part formed on part of an outer perimeter of the body;

a center hole formed in a center of the body;

an inner screw thread part formed on an inner perimeter of the center hole; and a flange part formed on a lower portion of the body, the flange part shaped as a round disc, being in contact with the tuning bolt and a cover of the RF cavity filter and having an upward slope of a designated incline for being in contact with the tuning bolt and the underside of the cover, wherein a tuning bolt used in tuning of the RF cavity filter is inserted into the center hole.

6. The grounding bolt for grounding a tuning bolt of an RF cavity filter according to claim 5, wherein a vertically upward force applied by a securing element causes a radius of the center hole to be made smaller and an inclined structure of the flange part to be bent by elastic force.

7. The grounding bolt for grounding a tuning bolt of an RF cavity filter according to claim 6, wherein the securing element comprises a nut.

* * * * *